US005524323A

United States Patent [19]

Lin

[11] Patent Number: 5,524,323

[45] Date of Patent: Jun. 11, 1996

[54] HINGE STRUCTURE

[76] Inventor: John C. L. Lin, Min Chuan Rd., Ta Fu Village, Fu Ne Hsiang, Kaohsiung Hsien, Taiwan

[21] Appl. No.: 364,921

[22] Filed: Dec. 28, 1994

[51] Int. Cl.[6] ..... E05D 7/04; E05D 11/10

[52] U.S. Cl. ..... 16/235; 16/325; 16/319

[58] Field of Search ..... 16/235, 242, 246, 16/319, 321, 322, 325

[56] References Cited

U.S. PATENT DOCUMENTS 4,332,053 6/1982 Salice ..... 16/235
4,665,587 5/1987 Kinaga et al. ..... 16/319
4,716,622 1/1988 Debruyn ..... 16/319
4,987,640 6/1991 Lin .

*Primary Examiner*—Maurina T. Rachuba
*Assistant Examiner*—Adesh Bhargava
*Attorney, Agent, or Firm*—Jacobson, Price, Holman & Stern

[57] ABSTRACT

A hinge structure includes a casing having a depression and a space for receiving a spring member and a base. The base is rotatably secured in the space and includes two cams. A hinge member includes an extension secured to the base and rotated in concert with the base. A spring includes two ends for resiliently engaging with the cams so as to position the cams and the hinge member in suitable angular position. The hinge structure includes a simplified configuration excellent for manufacturing and assembling purposes.

3 Claims, 3 Drawing Sheets

HINGE STRUCTURE

BACKGROUND OF THE INVENTION

1. Field of the Invention

The present invention relates to a hinge, and more particularly to a hinge structure.

2. Description of the Prior Art

Typical hinges comprise a rather complicated structure that is adverse for both manufacturing and assembling purposes. Particularly, the hinge structures can not be easily assembled onto the door panels. One of the typical hinge structures is disclosed in U.S. Pat. No. 4,987,640 and includes a rather complicated configuration.

The present invention has arisen to mitigate and/or obviate the afore-described disadvantages of the conventional hinge structures.

SUMMARY OF THE INVENTION

The primary objective of the present invention is to provide a hinge structure which includes a simplified configuration that is excellent for manufacturing and assembling purposes.

In accordance with one aspect of the invention, there is provided a hinge structure comprising a casing including a depression and a space formed therein and communicating with each other, a base rotatably secured in the space of the casing and including a cam means formed thereon, a hinge member including an extension secured to the base and rotated in concert with the base, a spring member including an end portion for resiliently engaging with the cam means so as to position the cam means and the hinge member in suitable angular position, and retaining means secured to the casing for retaining the spring member in place.

The retaining means includes a U-shaped retaining board member having a rivet member engaged with the casing so as to secure the retaining board member to the casing, the retaining board member is engaged with the spring member so as to retain the spring member in place. The retaining board member further includes a pair of fins extended therefrom for engaging with the spring member so as to further secure the spring member in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
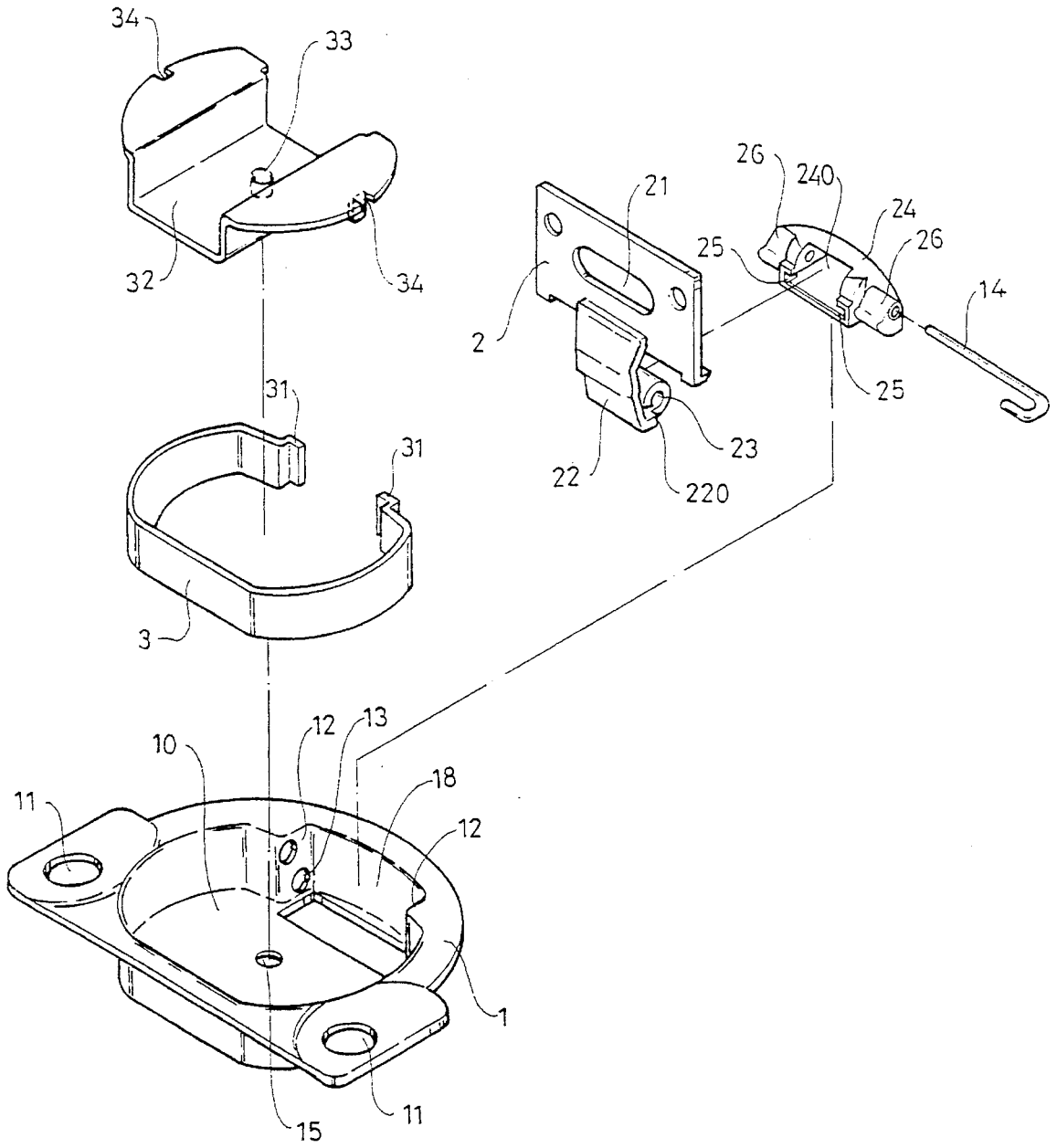
FIG. 1 is an exploded view of a hinge structure in accordance with the present invention.
Figure 2:
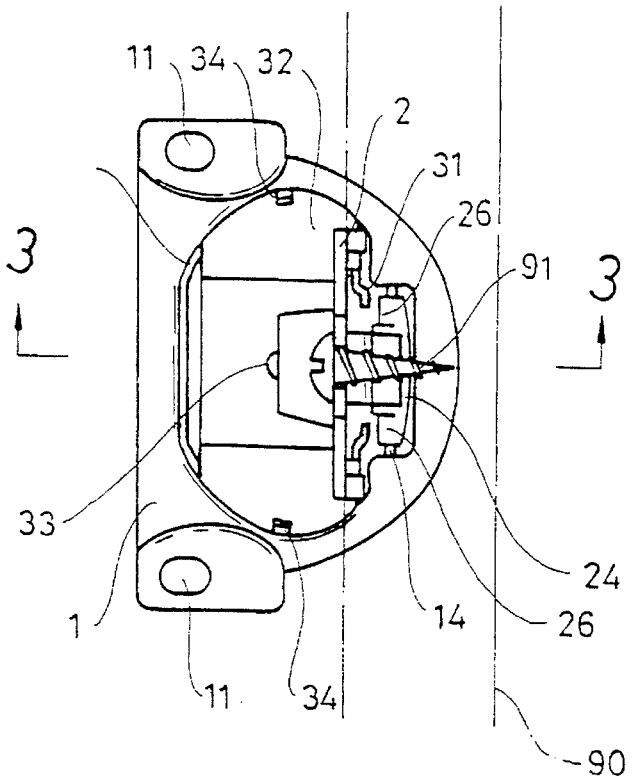
FIG. 2 is a front plane view of the hinge structure.
Figure 3:
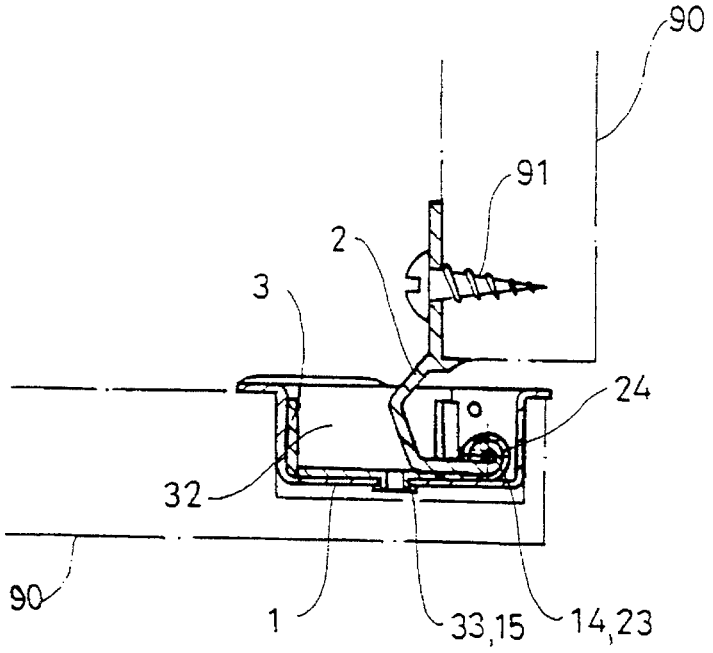
FIGS. 3 and 4 are cross sectional views taken along lines 3—3 of FIG. 2, illustrating the operation of the hinge structure.
Figure 4:
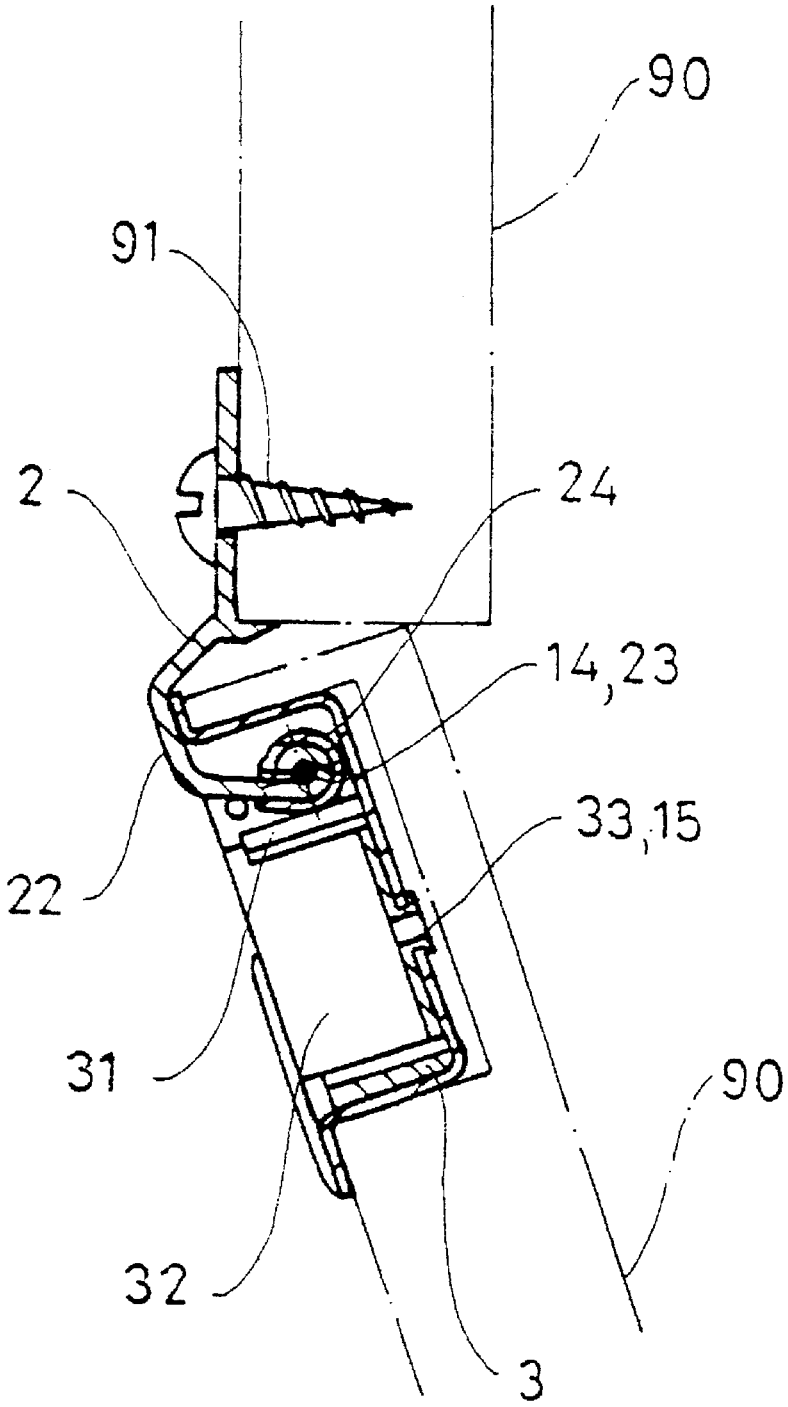

Referring to the drawings, and initially to FIGS. 1 to 3, a hinge structure in accordance with the present invention comprises a casing 1 including a number of holes 11 formed therein for engaging with screws or the like so as to secure the casing 1 to the door panel 90 or the like. The casing 1 includes a depression 10 formed therein, an orifice 15 formed in the depression 10 and a space 18 formed beside the depression 10 and communicating with the depression 10. The space 18 includes a pair of opposite sides 12 each having a hole 13 formed therein for engaging with a shaft 14.

A hinge member 2 includes one or more holes 21 formed therein for engaging with screws or the like so as to secure the hinge member 2 to the door panel 90 or the like. The hinge member 2 includes an extension 22 extended therefrom and having a curl 23 formed in the free end for rotatably engaging with the shaft 14. A base 24 is received in the space 18 and is rotatably secured onto the shaft 14 and includes an opening 240 formed therein for engaging with the curl 23 of the hinge member 2. The base 24 includes two notches 25 oppositely formed therein for engaging with two projections 220 of the extension 22 such that the hinge member 2 and the base 24 rotate in concert, and includes a pair of opposite cams 26 formed thereon for engaging with the casing 1.

A spring member 3 is engaged in the depression 10 of the casing 1 and includes two free ends 31 engaged with the cams 26 of the base 24 for positioning the base 24 in suitable angular position. A retaining board member 32 includes a U-shaped configuration having a projection 33 extended downward therefrom for engaging with the orifice 15 of the casing 1. The projection 33 may be riveted so as to secure the retaining board member 32 to the casing 1 for retaining the spring member 3 in place. The retaining board member 32 further includes two fins 34 extended downward for engaging with the spring member 3 and for further retaining the spring member 3 in place.

As shown in FIGS. 2 and 3, the casing 1 and the hinge member 2 may be easily secured to the door panels 90 by screws 91. The hinge member 2 and the base 24 may rotate about the shaft 14 and the free ends 31 of the spring member 3 may be engaged with the cams 26 so as to retain the hinge member 2 in suitable angular position relative to the casing 1.

Accordingly, the hinge structure in accordance with the present invention includes a simplified configuration that is excellent for manufacturing and for assembling purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hinge structure comprising:

a casing including a depression and a space formed therein and communicating with each other, a base rotatably secured in said space of said casing and including cam means formed on opposite ends of said base, a hinge member including an extension secured to said base and rotated in concert with said base, a spring member including end portions for resiliently engaging with said cam means so as to position said cam means and said hinge member in suitable angular position, and retaining means secured to said casing for retaining said spring member in place.

2. A hinge structure comprising:

a casing including a depression and a space formed therein and communicating with each other, a base rotatably secured in said space of said casing and including a cam means formed thereon, a hinge member including an extension secured to said base and rotated in concert with said base, a spring member including an end portion for resiliently engaging with said cam means so as to position said cam means and said hinge member in suitable angular position, and retaining means secured to said casing for retaining said spring member in place, wherein said retaining means includes a U-shaped retaining board member having a rivet member engaged with said casing so as to secure said retaining board member to said casing, and wherein said retaining board member is engaged with said spring member so as to retain said spring member in place.

3. A hinge structure according to claim 2, wherein said retaining board member further includes a pair of fins extended therefrom for engaging with said spring member so as to further secure said spring member in place.

* * * * *